United States Patent [19]

Kagawa et al.

[11] Patent Number: 4,894,498

[45] Date of Patent: Jan. 16, 1990

[54] PUSH BUTTON SWITCH HAVING RADIAL LEADS

[75] Inventors: Kazuyoshi Kagawa; Takeshi Hakozaki, both of Iwaki, Japan

[73] Assignee: Alps Electric Co., Ltd., Tokyo, Japan

[21] Appl. No.: 187,824

[22] Filed: Apr. 29, 1988

[30] Foreign Application Priority Data

Jun. 4, 1987 [JP] Japan ..... 62-86191[U]

[51] Int. Cl.[4] ..... H01H 13/10

[52] U.S. Cl. ..... 200/284; 200/534

[58] Field of Search ..... 200/284, 292, 294, 295, 200/293, 406, 517, 520, 534, 535

[56] References Cited

U.S. PATENT DOCUMENTS

| | | | |
|---|---|---|---|
| 4,152,565 | 5/1979 | Rose | 200/292 X |
| 4,331,851 | 5/1982 | Johnson | 200/159 B |
| 4,359,614 | 11/1982 | Green et al. | 200/406 X |
| 4,595,809 | 6/1986 | Pool | 200/406 |
| 4,739,139 | 4/1988 | Ikeda | 200/284 X |
| 4,751,385 | 6/1988 | Van Benthusysen et al. | 200/284 X |

FOREIGN PATENT DOCUMENTS

| | | | |
|---|---|---|---|
| 1114891 | 10/1961 | Fed. Rep. of Germany | 200/284 |
| 1363652 | 8/1974 | United Kingdom . | |
| 1409184 | 10/1975 | United Kingdom . | |
| 2028591A | 3/1980 | United Kingdom . | |

*Primary Examiner*—Renee S. Luebke

*Attorney, Agent, or Firm*—Guy W. Shoup; Brian D. Ogonowsky; David W. Heid

[57] ABSTRACT

A push button switch is disclosed having a case in which fixed contacts are arranged on an inner bottom surface of the case. A pair of terminals, formed integrally with the fixed contacts, project through the case and into a pair of recesses having vertical walls formed in a lower portion of the case. The terminals projecting into the recesses are both bent at substantially right angles to said fixed contacts so as to be arranged along the vertical walls of the recesses. The pair of terminals are thus formed to be in a same plane and enable the push button switch to be installed in a printed circuit board by an automatic inserter for radial lead type electronic parts.

1 Claim, 3 Drawing Sheets

PUSH BUTTON SWITCH HAVING RADIAL LEADS

BACKGROUND OF THE INVENTION

1. Field of the Invention

The present invention relates to a small-sized push button switch to be used in various office automation equipment, apparatuses to be mounted in a vehicle, and the like, and in particular, to a push button switch in which a portion of a metal sheet member employed as terminals and fixed contacts is installed in a case through an insertion molding process.

2. Description of the Prior Art

Based on specifications of the projection of terminals (leads), electronic parts can be briefly classified into radial lead electronic parts, axial lead electronic parts, and electronic parts of different shapes.

The radial lead electronic parts are represented by, as shown in FIG. 7, such parts as a capacitor 20 of which leads 20*a*, 20*a* are projected in the same direction. The capacitors 20 arranged on a holder sheet 21 by use of an adhesive tape 22 are supplied to an automatic dispenser of radial lead electronic parts so as to be mounted on printed circuit boards.

The axial lead electronic parts are represented by, as shown in FIG. 8, such parts as a resistor 23 of which leads 23*a*, 23*a* extend from the body thereof toward the right and left directions. The resistors 23 arranged on holder sheets 21 by use of an adhesive tape 22 are supplied to an automatic dispenser of radial lead electronic parts so as to be similarly mounted or installed on printed circuit boards.

Moreover, the electronic parts of different shapes are represented by, as shown in FIGS. 9–10, parts such as a push button switch 24 of which, for example, four leads 24*a* project in the respective directions. The push button switches 24 arranged in holding member 25 are supplied to an automatic dispenser of electronic parts of different shapes manufactured specifically for the respective parts of different shapes so they may be similarly mounted on printed circuit boards.

Among the respective automatic inserters of the radial lead electronic parts, axial lead electronic parts, and electronic parts of different shapes described above, the automatic inserter of the radial lead electronic parts is most popular and has a simple structure, whereas the automatic inserter of the parts of different shapes must be manufactured for a dedicated use and hence its cost is increased. Consequently, in a case where the number of parts to be installed in a printed circuit board is small, manual assembly is commonly used for the installation of parts of different shapes, such as the push button switch. In this case, however, the automation line must include manual assembly, resulting in reduced assembly efficiency.

SUMMARY OF THE INVENTION

It is therefore an object of the present invention to provide a push button switch which can be installed in a printed circuit board by use of an automatic inserter of radial lead electronic parts, thereby removing the disadvantages of the prior art technology.

The objects of the present invention described above can be achieved by a push button switch having a case in which fixed contacts are fixedly arranged on an inner bottom surface of said case and a pair of terminals formed integrally with said fixed contacts projected toward an outside of said case wherein a pair of recesses respectively having vertical walls are formed in a lower portion of said case and said terminals respectively located in said recesses are bent at a substantially right angle so as to be arranged along said vertical walls, thereby locating said terminals in a same plane.

As a consequence, the push button switch possesses a terminal projection specification similar to that of the radial lead electronic parts such as a capacitor, which enables the push button switch to be installed in a printed circuit board by use of an automatic inserter of radial lead electronic parts.

BRIEF DESCRIPTION OF THE DRAWINGS

The present invention will be apparent from the following detailed description taken in conjunction with the accompanying drawings in which.

DESCRIPTION OF THE PREFERRED EMBODIMENT

Figure 1:
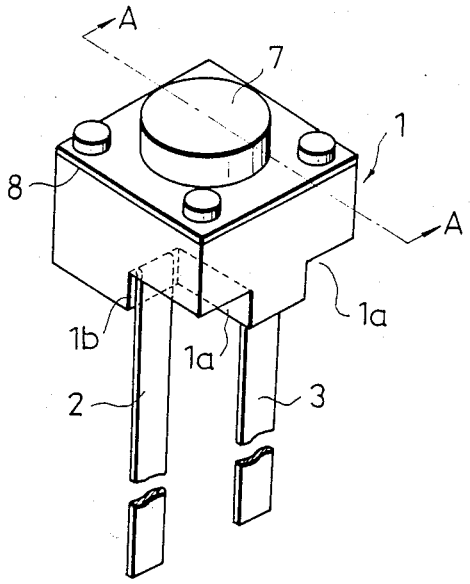
FIG. 1 is a perspective view of a push button switch as an embodiment according to the present invention.
Figure 2:
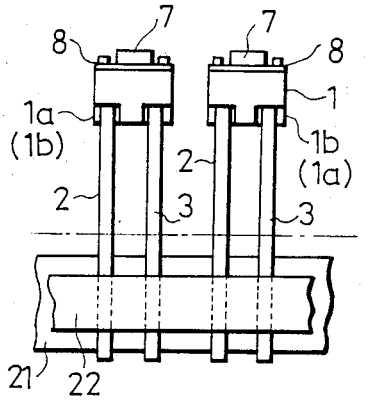
FIG. 2 is an explanatory diagram showing a state where the push button of FIG. 1 is mounted in a holder sheet.

Referring now to FIGS. 1–6, description will be given of an embodiment of the present invention.

In the drawings, case 1 is made of a plastic and is opened on top. In the lower portion of case 1, a pair of recesses 1*a*, 1*a* are formed to be symmetric with respect to line A—A (central longitudinal line) of FIG. 1. The recesses 1*a*, 1*a* respectively are provided with vertical walls 1*b*, 1*b* located in the same plane (one of the vertical walls is omitted for convenience of the illustration in FIG. 1).

Reference numerals 2–3 are leads formed of metal sheets each having a high conductivity. A portion of each of the leads 2–3 is buried in the case 1 by an insertion molding process. Exposed on the inner bottom surface of case 1 (FIG. 3) are fixed contacts 2*a*, 2*a*, and 3*a* which are respectively linked with the leads 2–3.

Figure 4:
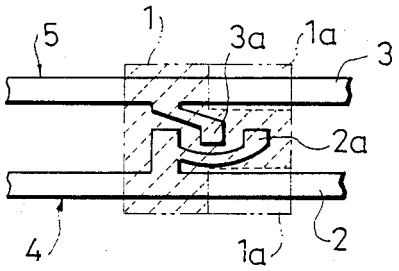
FIG. 4 is a plan view of primary portions showing members to be employed as leads and fixed contacts in the push button switch of FIG. 1.

Metal sheets 4–5 forming the leads 2–3 and the fixed contacts 2*a*–3*a* have shapes shown in FIG. 4. The hatched section of FIG. 4 is subjected to the insertion molding when the case 1 is molded leaving fixed contacts 2*a*–3*a* exposed.

Figure 5:
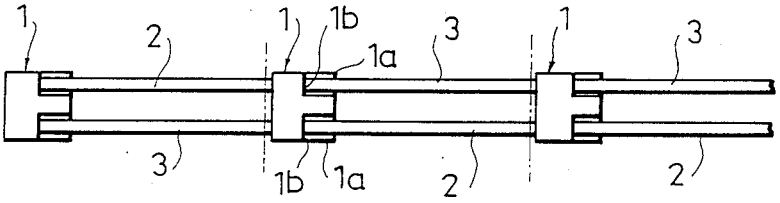
FIG. 5 is a rear view showing the members and the case after undergoing an insertion molding process in the push button switch of FIG. 1.
Figure 6:
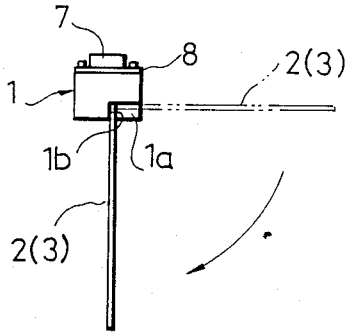
FIG. 6 is an explanatory diagram showing a process to bend a lead in the push button switch of FIG. 1.
Figure 7:
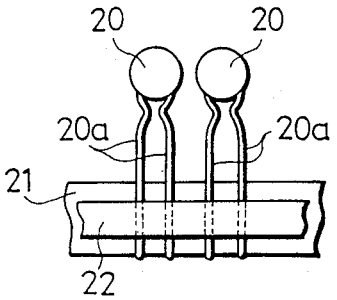
FIG. 7 is a plan view of primary portions showing an example of a radial electronic part.
Figure 8:
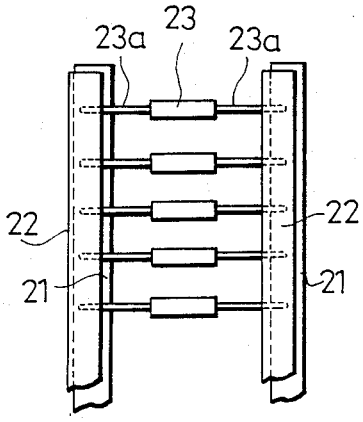
FIG. 8 is a plan view of primary portions showing an example of an axial electronic part.
Figure 9:
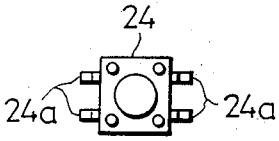
Fig.9 PRIOR ART
FIG. 9 is a top view of a conventional push button switch.
Figure 10:
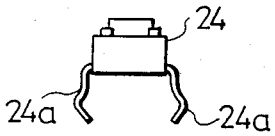
Fig.10 PRIOR ART
FIG. 10 is a front view thereof.
Figure 11:
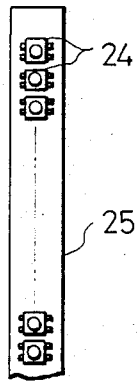
Fig.11 PRIOR ART
FIG. 11 is an explanatory diagram showing the conventional push button switches mounted on a holding member.

Along the dot-and-dash line of FIG. 5, viewed from the rear side of the case 1 after the insertion molding, metal sheets 4–5, each having a narrow width are cut off after a movable contact, a stem, and the like (to be described later) are installed, the leads 2–3 are, as shown in FIG. 6, bent in a substantially right angle from the horizontal shape so as to be respectively arranged along the vertical walls 1*b*. The vertical leads 2–3 are thus formed in accordance with the lead projection specification associated with the radial leads in which the leads 2–3 extend in the same direction in the same plane.

Figure 3:
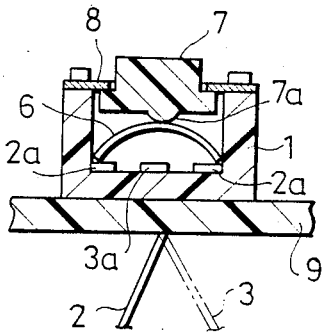
FIG. 3 is a cross-sectional view of primary portions where the push button of FIG. 1 is mounted on a printed circuit board.

Reference numeral 6 in FIG. 3 indicates a known movable contact which is made of a metal sheet having a high conductivity and which is substantially shaped, for example, in a form of a small dome. The movable contact 6 is mounted on the inner bottom surface of the case 1 such that a peripheral portion thereof is brought into contact with the fixed contacts 2*a*, 2*a* for electric conduction, and a surface of a top portion of the movable contact 6 is pressed by a stem, to be described later, such that a central portion thereof is inversely curved or bent so as to establish an electrical conduction between the rear surface of the top portion and the fixed contact 3*a* and, consequently, conduction between the fixed contacts 2*a* and 3*a*.

Reference numeral 7 designates a stem of which a lower projection 7*a* is brought into contact with the top portion of the movable contact 6 and which is provided with a bias toward the upward direction as shown in FIG. 3 due to a self-restoring characteristic of the movable contact 6. Reference numeral 8 is a holding or retaining plate to prevent the stem 7 from falling out therefrom and is fixed on an upper end surface of the case 1 through an appropriate means such as a screw, a strong engagement, or a thermal calking.

The push button switch configured above is an electronic part of the radial lead type in which the leads 2–3 are extended in the same direction in the same plane. As a consequence, where the end portions of the leads 2–3 are arranged and are fixed on a holder sheet 21 by means of an adhesive tape 22, the push button switches are supplied to an automatic inserter of radial lead electronic parts, and the push button switches are automatically cut off at the portion of the dot-and-dash line of FIG. 2 and installed at predetermined positions on a printed circuit board.

In addition, since the leads 2–3 are bent at a substantially right angle along the vertical walls 1*b*, 1*b* in a substantially central portion of the lower portion of the case 1, the case 1 is not inclined when mounted on the printed circuit board. Particularly, if the leads 2–3 are bent by use of a clincher means after the leads 2–3 are inserted in the printed circuit board 9 as shown in FIG. 3, case 1 is further assured of not being inclined with respect to printed circuit board 9.

In another embodiment, recesses similar to those disposed on the sides of the leads 2 and 3 in FIG. 5 are formed for metal sheets 4 and 5 in FIG. 4, and the metal sheets 4 and 5 are bent by a substantially right angle in the recessed portions. In this embodiment, since metal sheets can be located inside of the side surfaces of the case 1, when both side surfaces of the case 1 are held in the automatic inserter, there is less likelihood of damage to protection members such as rubber members disposed in a chucking section of the automatic inserter.

As described above, according to the present invention, there is provided a push button switch which can be mounted or installed on a printed circuit board by use of an automatic inserter for radial lead electronic parts.

While the present invention has been described with reference to a particular illustrative embodiment, it is not restricted by the embodiment but only by the appended claims. It is to be appreciated that those skilled in the art can change or modify the embodiment without departing from the scope and spirit of the present invention.

What is claimed is:

1. A push button switch for use with radial lead automatic insertion equipment comprising:

a case;

fixed contacts arranged on an inner bottom surface of said case and positioned in a substantially horizontal plane;

a movable contact supported in said case for movement vertically with respect to said horizontal plane;

a push button stem movably supported in said case in an operative relationship with said movable contact for movement vertically with respect to said horizontal plane;

a pair of terminals formed integrally with said fixed contacts and extending away from said fixed contacts in a same direction, said fixed contacts and said terminals being formed of metal sheet material;

a pair of recesses formed in an outer bottom surface of said case, each of said recesses having a vertical wall and a horizontal wall, said terminals projecting out from said case horizontally where said recesses are located, said terminals projecting through said vertical wall of said recesses at a point where said horizontal and vertical walls of said recesses meet, said terminals being identically bent at substantially right angles with respect to said fixed contacts so as to be arranged against an outside surface of said vertical walls of said recesses, portions of said terminals which are at substantially right angles with respect to said fixed contacts being parallel, coplanar and positioned in a single row so as to form radial leads of said push button switch.

* * * * *